US008253642B2

(12) United States Patent
Chang et al.

(10) Patent No.: US 8,253,642 B2
(45) Date of Patent: Aug. 28, 2012

(54) LEAKY-WAVE ANTENNA CAPABLE OF MULTI-PLANE SCANNING

(75) Inventors: Rong-Yuan Chang, Hsinchu (TW); Fu-Chiarng Chen, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 358 days.

(21) Appl. No.: 12/757,058

(22) Filed: Apr. 9, 2010

(65) Prior Publication Data

US 2011/0148727 A1 Jun. 23, 2011

(30) Foreign Application Priority Data

Dec. 23, 2009 (TW) ..... 98144536 A

(51) Int. Cl.
*H01Q 13/20* (2006.01)

(52) U.S. Cl. ..... 343/777; 343/700 MS; 343/756; 343/776

(58) Field of Classification Search ..... 343/700, 343/756, 776, 777
See application file for complete search history.

(56) References Cited

U.S. PATENT DOCUMENTS 4,618,865 A * 10/1986 Lamensdorf et al. ..... 343/776
6,317,095 B1 * 11/2001 Teshirogi et al. ..... 343/785
7,253,780 B2 * 8/2007 Sievenpiper ..... 343/745
7,868,829 B1 * 1/2011 Colburn et al. ..... 343/700 MS
8,026,854 B2 * 9/2011 Sanada ..... 343/700 MS
2010/0309079 A1 * 12/2010 Rofougaran et al. ..... 343/777

FOREIGN PATENT DOCUMENTS

TW 465140 11/2001
TW M267648 6/2005

OTHER PUBLICATIONS

Nguyen et al., "Pencil-Beam Full-Space Scanning 2D CRLH Leaky-Wave Antenna Array," ISSSE, Montreal, 2007.
Lai et al., "Leaky-Wave Steering in a Two-Dimensional Metamaterial Structure Using Wave Interaction Excitation," Proc. Int. Microwave Symposium (IMS), 2006.

* cited by examiner

*Primary Examiner* — Tho G Phan
(74) *Attorney, Agent, or Firm* — Jianq Chyun IP Office

(57) ABSTRACT

A leaky-wave antenna capable of multi-plane scanning is provided. The leaky-wave antenna includes a substrate, a first antenna series, a second antenna series and a plurality of control units. The first antenna series intersects with the second antenna series to share a predetermined antenna unit among many antenna units. A part of the antenna units is connected in series to extend from a first and a second transmission lines of the predetermined antenna unit to compose the first antenna series, and the other antenna units are connected in series to extend from a third and a fourth transmission lines of the predetermined antenna unit to compose the second antenna series. The control units control the transmission paths between the first to the fourth transmission lines and the antenna units, and switch a leaky beam to different scanning planes, wherein the leaky beam scans with frequency variation through the antenna units.

12 Claims, 8 Drawing Sheets

LEAKY-WAVE ANTENNA CAPABLE OF MULTI-PLANE SCANNING

CROSS-REFERENCE TO RELATED APPLICATION

This application claims the priority benefit of Taiwan application serial no. 98144536, filed on Dec. 23, 2009. The entirety of the above-mentioned patent application is hereby incorporated by reference herein and made a part of specification.

BACKGROUND OF THE INVENTION

1. Field of the Invention

The present invention relates to an antenna. More particularly, the present invention relates to a leaky-wave antenna capable of multi-plane scanning.

2. Description of Related Art

With booming development of wireless communication technology and liberalization of telecommunication, various communication protocol specifications and techniques are provided for achieving a better communication quality in an effective bandwidth. Moreover, since an antenna is one of indispensable elements in a wireless communication system, to design an antenna capable of improving a system performance is an important issue.

In a current communication system, the antenna generally has a characteristic of a wide beam pattern, for example, an omni directional and single beam. Generally, signals transmitted by an omni directional antenna and a directional antenna are liable to be influenced by multi-path fading and similar signals, so that a communication quality is influenced. To resolve the above problem, development of a smart antenna is one of the most promising technologies. Generally, the smart antennas can be group into switched beam antennas and scanning beam antennas. The switched beam antenna can change a beam shape and a beam direction of the antenna to increase an antenna gain and reduce the noise interference. The scanning beam antenna is implemented with assistant of active components or implemented by a leaky-wave antenna.

Presently, it is known that designs of the switched-beam antenna or the scanning beam antenna are approximately categorized into following types. The first type is to use a 90-degree coupler to feed into an antenna array, and different ports of the coupler are changed to serve as an input port, so as to achieve a beam switching effect. The second type is to design a Yagi antenna, and a PIN diode is added into a parasitic device, so that a length of the parasitic device is changed according to whether the PIN diode is conducted for serving as a reflection device or a guided-wave device, so as to achieve an effect of switching the beam direction. The third type is to use a Butler matrix to match an antenna array, and use a beam-forming technique for implementation.

Although the current techniques can achieve the beam switching effect, there is a plurality of shortages. For example, regarding the technique of changing different ports of the coupler to serve as the input port, the unused ports have to be connected with matched impedances for normal operation, which may lead to an operation inconvenience. Regarding the Yagi antenna designed according to a monopole antenna technique, etc., the antenna does not have a low profile characteristic, and slimness of the antenna cannot be implemented. Moreover, regarding the beam-forming technique, a complicated and large-area feed-in network and an antenna array have to be used to implement switching of the multiple beam directions, so that miniaturization thereof is hard to be achieved. Moreover, none of the above methods can achieve a beam scanning function.

SUMMARY OF THE INVENTION

The present invention is directed to a leaky-wave antenna capable of multi-plane scanning, which has a beam scanning function and a beam switching function, and also has an advantage of miniaturization due to usage of a planar structural design.

The present invention provides a leaky-wave antenna capable of multi-plane scanning. The leaky-wave antenna includes a substrate, a first antenna series, a second antenna series and a plurality of control units. The first antenna series and the second antenna series are disposed on the substrate, and include a plurality of antenna units. Moreover, the first antenna series intersects with the second antenna series to share a predetermined antenna unit among the antenna units. A part of the antenna units are connected in series to extend outwards from a first and a second transmission lines of the predetermined antenna unit to form the first antenna series, and the other antenna units are connected in series to extend outwards from a third and a fourth transmission lines of the predetermined antenna unit to form the second antenna series. The control units are disposed at peripheral of the predetermined antenna unit for controlling transmission paths between the first to the fourth transmission lines and the antenna units, and switching a leaky beam to one of a plurality of scanning planes, wherein the leaky beam performs scanning along with a frequency variation through the antenna units.

In an embodiment of the present invention, the antenna units respectively comprise a metal ground layer, a metal sheet, a first conductive via, a fifth transmission line, a second conductive via, a sixth transmission line, and a third conductive via. The metal ground layer is disposed on a first surface of the substrate, and has a plurality of slots for dividing a plurality of metal blocks that are not electrically connected with each other. The metal sheet is disposed on a second surface of the substrate, and is partially overlapped to the metal blocks in a vertical projection plane. The first conductive via penetrates through the metal ground layer, the substrate and the metal sheet, and the metal sheet is electrically connected to the metal ground layer through a first conductive pole in the first conductive via.

Moreover, the fifth transmission line is disposed on the second surface of the substrate and located at a side of the metal sheet, and the fifth transmission line is partially overlapped to a first metal block of the metal blocks on the vertical projection plane. The second conductive via penetrates through the fifth transmission line, the substrate and the first metal block, and the fifth transmission line is electrically connected to the first metal block through a second conductive pole in the second conductive via. The sixth transmission line is disposed on the second surface of the substrate and located at another side of the metal sheet, and the sixth transmission line is partially overlapped to a second metal block of the metal blocks on the vertical projection plane. The third conductive via penetrates through the sixth transmission line, the substrate and the second metal block, and the sixth transmission line is electrically connected to the second metal block through a third conductive pole in the third conductive via.

In an embodiment of the present invention, the antenna units are respectively equivalent to a composite right/left-hand (CRLH) transmission line, and a balance frequency point of the CRLH transmission line relates to sizes of the metal sheet, the first conductive pole, the second conductive pole and the metal blocks. Moreover, the metal sheet, the first conductive pole and the metal ground layer are equivalent to a left-hand inductor of the CRLH transmission line, and the fifth transmission line, the first metal block and the second conductive pole are equivalent to a left-hand capacitor of the CRLH transmission line.

According to the above descriptions, in the present invention, the antenna series having the beam scanning function are disposed in intersection, and the control units are used to control conduction states of the transmission paths. In this way, the leaky beam radiated by the leaky-wave antenna capable of multi-plane scanning is switched to one of the scanning planes, and an original sweep-frequency characteristic of the antenna series is maintained. Moreover, the leaky-wave antenna capable of multi-plane scanning has a planar structural design, so that it can be miniaturized. Since the antenna series are disposed in intersection, the circuit features of the leaky paths of the antenna are similar, so that usage of complicated matching circuits is unnecessary.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
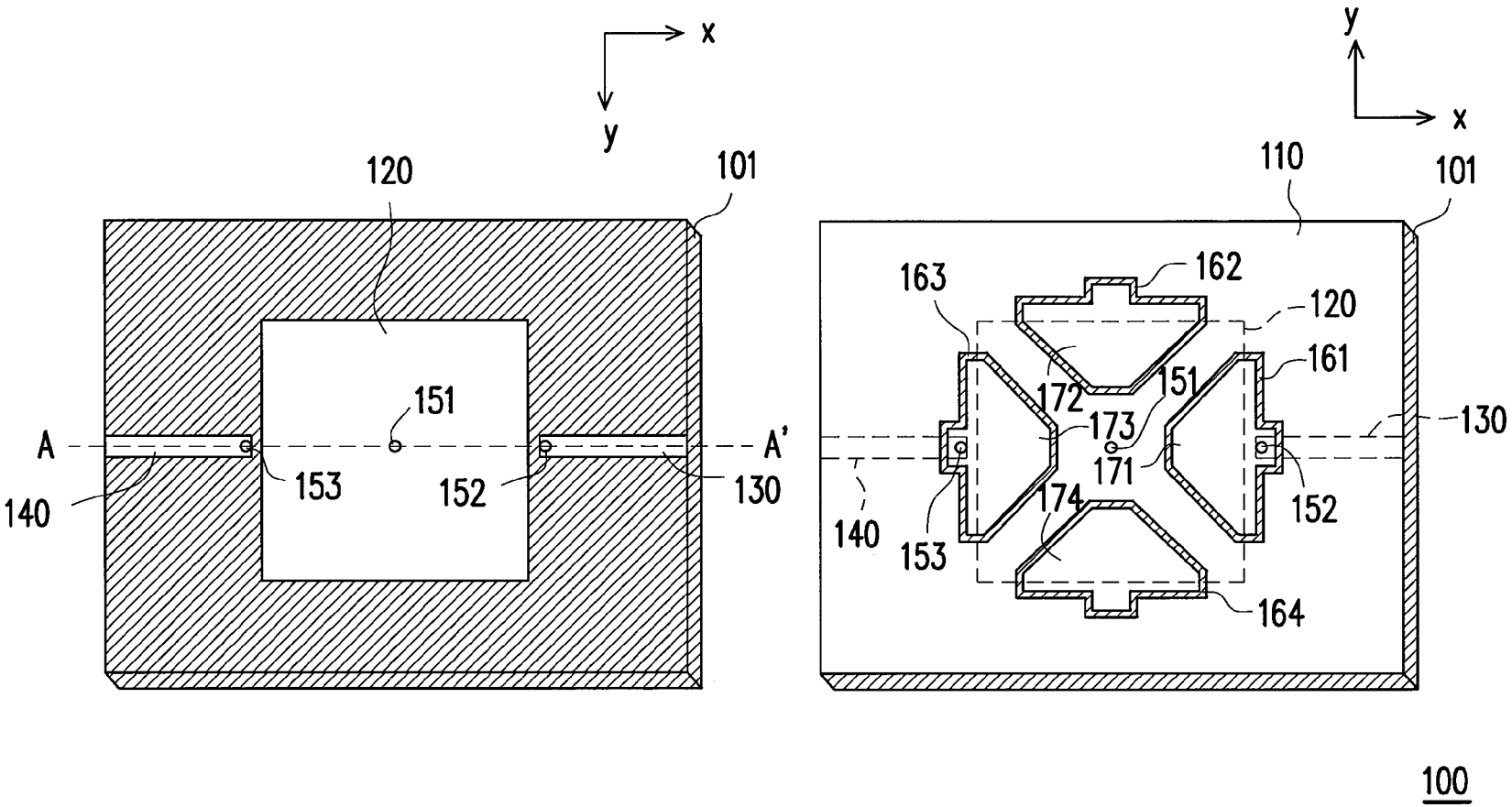
FIG. 1 is a schematic diagram illustrating a structure of an antenna unit according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

In the present invention, antenna series are disposed in intersection to form a leaky-wave antenna capable of multi-plane scanning, and each of the antenna series is formed by serially connecting a plurality of antenna units. Moreover, control units are disposed aside the intersection of the antenna series, so that a leaky beam radiated by the leaky-wave antenna capable of multi-plane scanning can be switched to one of scanning planes. Moreover, each of the antenna units is designed to be a composite right/left-hand (CRLH) transmission line structure, so that the leaky beam can implement a sweep-frequency mechanism through the antenna units. To further convey the spirit of the present invention to those skilled in the art, a structure of the antenna unit is first described below, and the antenna series formed by serially connecting the antenna units, and the leaky-wave antenna capable of multi-plane scanning that is formed by the antenna series and the control units are described in succession.

FIG. 1 is a schematic diagram illustrating a structure of an antenna unit according to an embodiment of the present invention. Referring to FIG. 1, the antenna unit 100 has a planar structural design, which is disposed on a substrate 101. The substrate 101 has a first surface and a second surface. Moreover, the antenna unit 100 includes a metal ground layer 110, a metal sheet 120, a transmission line 130, a transmission line 140 and conductive vias 151-153.

Further, the metal ground layer 110 is disposed on the first surface of the substrate, and has a plurality of slots 161-164. The slots 161-164 expose the first surface of the substrate, and respectively form a closed loop. Therefore, the slots 161-164 can divide the metal ground layer 110 into a plurality of metal blocks 171-174 that are not electrically connected with each other. Moreover, the metal sheet 120, the transmission line 130 and the transmission line 140 are all disposed on the second surface of the substrate. For simplicity's sake, relative positions of the metal sheet 120, the transmission line 130 and the transmission line 140 that are projected on the first surface of the substrate are further illustrated by dot lines in FIG. 1.

As shown in FIG. 1, if the first surface of the substrate is regarded as a vertical projection plane, regarding physical configurations, the metal sheet 120 is partially overlapped to the metal blocks 171-174 on the vertical projection plane. Moreover, the metal blocks 171-174 are mutually symmetric relative to a geometric center of the metal sheet 120, and the conductive via 151 is overlapped to the geometric center of the metal sheet 120 on the vertical projection plane. On the other hand, the transmission line 130 is located at a side of the metal sheet 120, and is partially overlapped to the metal block 171 on the vertical projection plane. Moreover, the transmission line 140 is located at another side of the metal sheet 120, and is partially overlapped to the metal block 173 on the vertical projection plane.

Figure 2:
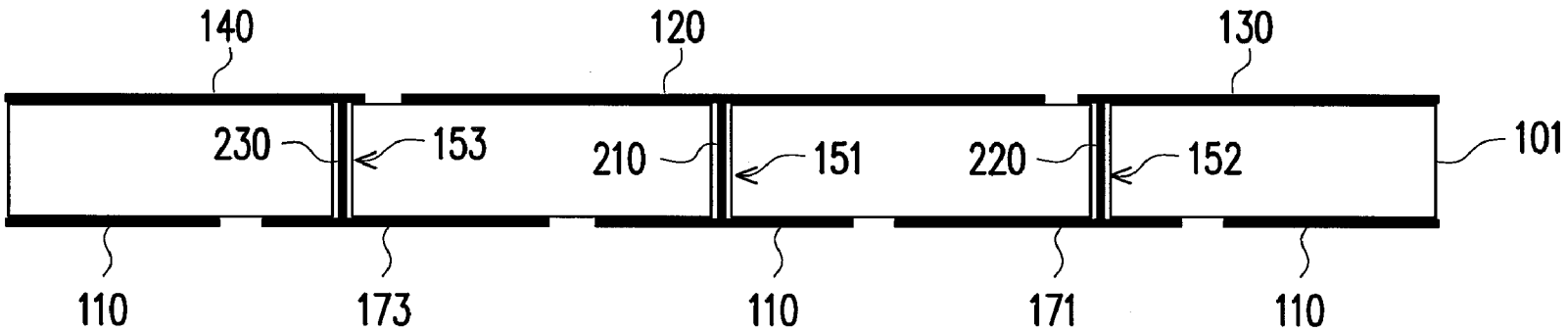
FIG. 2 is a cross-sectional view of an antenna unit of FIG. 1 along a line A-A'.

FIG. 2 is a cross-sectional view of the antenna unit 100 along a line A-A'. Referring to FIG. 1 and FIG. 2, the conductive via 151 penetrates through the metal ground layer 110, the substrate 101 and the metal sheet 120. Therefore, the metal sheet 120 can be electrically connected to the metal ground layer 110 through a conductive pole 210 in the first conductive via 151. Moreover, the conductive via 152 penetrates through the transmission line 130, the substrate 101 and the metal block 171. Therefore, the transmission line 130 can be electrically connected to the metal block 171 through a conductive pole 220 in the conductive via 152. Moreover, the conductive via 153 penetrates through the transmission line 140, the substrate 101 and the metal block 173. Therefore, the transmission line 140 can be electrically connected to the metal block 173 through a conductive pole 230 in the conductive via 153.

It should be noticed that according to the above configurations, the antenna unit 100 is equivalent to a CRLH transmission line. The metal sheet 120, the conductive pole 210 and the metal ground layer 110 are equivalent to a left-hand inductor of the CRLH transmission line, and the transmission line 130, the metal block 171 and the conductive pole 220 are equivalent to a left-hand capacitor of the CRLH transmission line. Comparatively, a balance frequency point of the CRLH transmission line is determined according to sizes of the metal sheet 120, the conductive pole 210, the conductive pole 220 and the metal blocks 171-174.

In other words, a part of the areas of the metal ground layer 110 is hollowed by the slots 161-164, and the metal blocks 171-174 divided by the slots 161-164 are respectively used to form one piece of metal sheet of a metal-insulator-metal (MIM) capacitor. Namely, in the present embodiment, a mushroom-like structure in a meta-material is combined with the MIM capacitor to form the left-hand inductor and the left-hand capacitor additionally required by the CRLH transmission line. Therefore, compared to a conventional MIM capacitor structure which requires an additional substrate to support a metal sheet thereof, in the present embodiment, only one substrate is used to implement the circuit structure of the CRLH transmission line, so that a low profile characteristic of the antenna is achieved, and the antenna is easy to be integrated with a planar printed circuit board.

Figure 3:
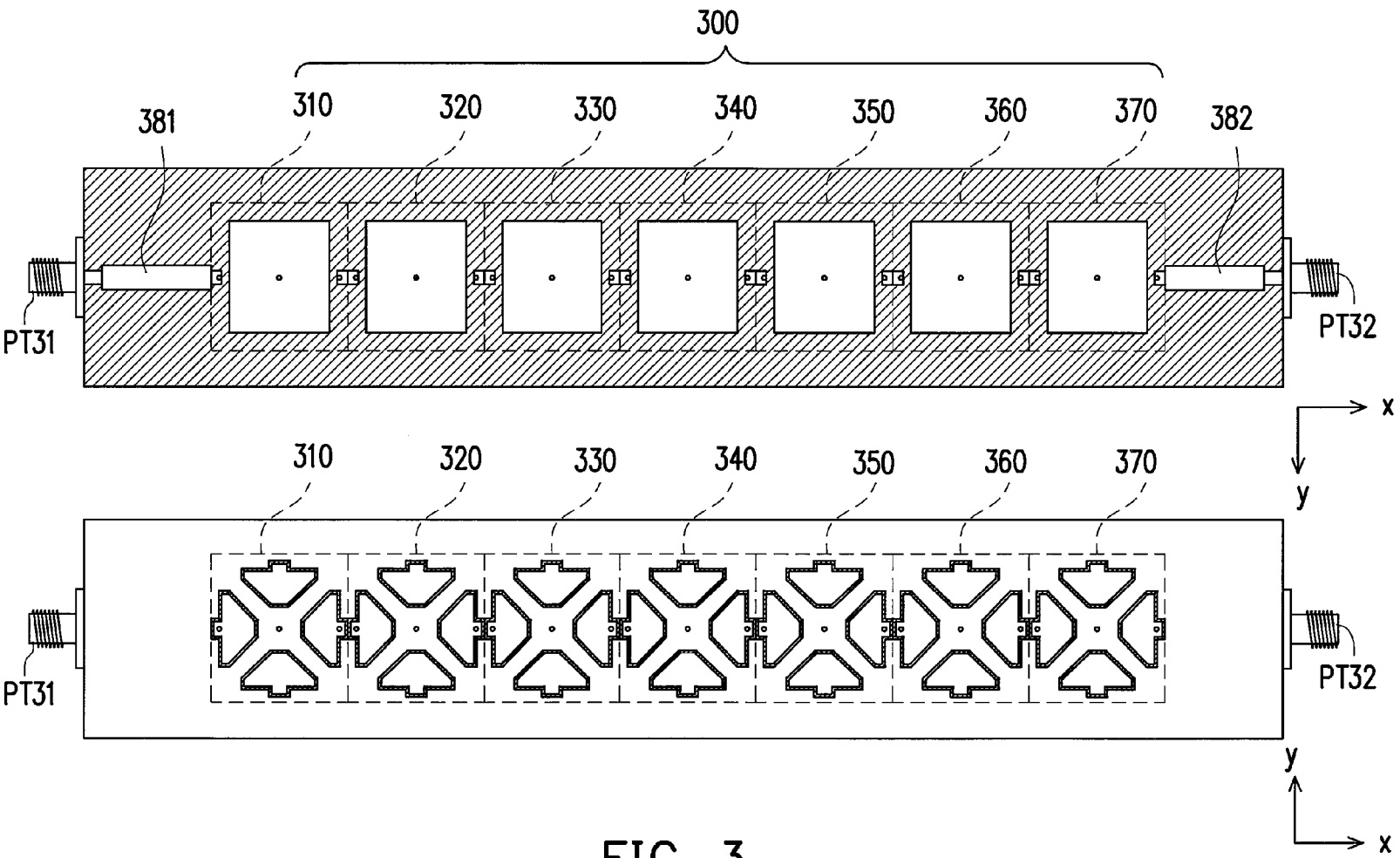
FIG. 3 is a structural schematic diagram illustrating an antenna series according to an embodiment of the present invention.

Furthermore, the antenna units 100 can be connected in series to form an antenna series. For example, FIG. 3 is a structural schematic diagram illustrating an antenna series according to an embodiment of the present invention. Referring to FIG. 3, the antenna series 300 includes a plurality of antenna units 310-370, wherein configurations of the antenna units 310-370 are the same to that of the antenna unit 100 of FIG. 1. Here, the antenna units 310-370 are respectively connected to the tandem antenna units in series through the internal transmission lines thereof, so as to form the antenna series 300. Moreover, since a Bloch impedance of the CRLH transmission line is about 20 ohms, two ends of the antenna series 300 can be electrically connected to matching wires 381 and 382 with a quarter wavelength, so as to match impedances of feed-in ports PT31 and PT32.

During an actual operation, when energy is transmitted to one end of the antenna series 300 from the feed-in port PT31, the other end of the antenna series 300 is electrically connected to a terminator of 50 ohms through the feed-in port PT32, so as to form the leaky-wave antenna structure. Moreover, a leaky beam radiated by the antenna series 300 can perform a continuous scanning along with a frequency variation, i.e. from a backward radiation formed at a low frequency left-hand leaky area to a forward radiation formed at a high frequency right-hand leaky area, which includes a broadside radiation scanned at the balance frequency point. Namely, when an operation frequency of the antenna series 300 is less than the balance frequency point, the antenna series 300 works at the left-hand leaky area and generates the backward radiation. When the operation frequency of the antenna series 300 is the balance frequency point, the antenna series 300 generates the broadside radiation. When the operation frequency of the antenna series 300 is greater than the balance frequency point, the antenna series 300 works at the right-hand leaky area and generates the forward radiation.

It should be noticed that the leaky areas of the antenna series 300 are operated in a fundamental mode rather than a high-order mode, so that a scanning angle and a radiation characteristic thereof are all better than that of a conventional leaky-wave antenna. Moreover, although the antenna series 300 of FIG. 3 is composed of 7 antenna units, a number of the antenna units used for forming the antenna series is not limited thereto. Those skilled in the art can arbitrarily modify the number of the antenna units according to actual design requirements, and a radiation gain and a directivity of the antenna series are correspondingly increased as the number of the antenna units is increased.

Figure 4:
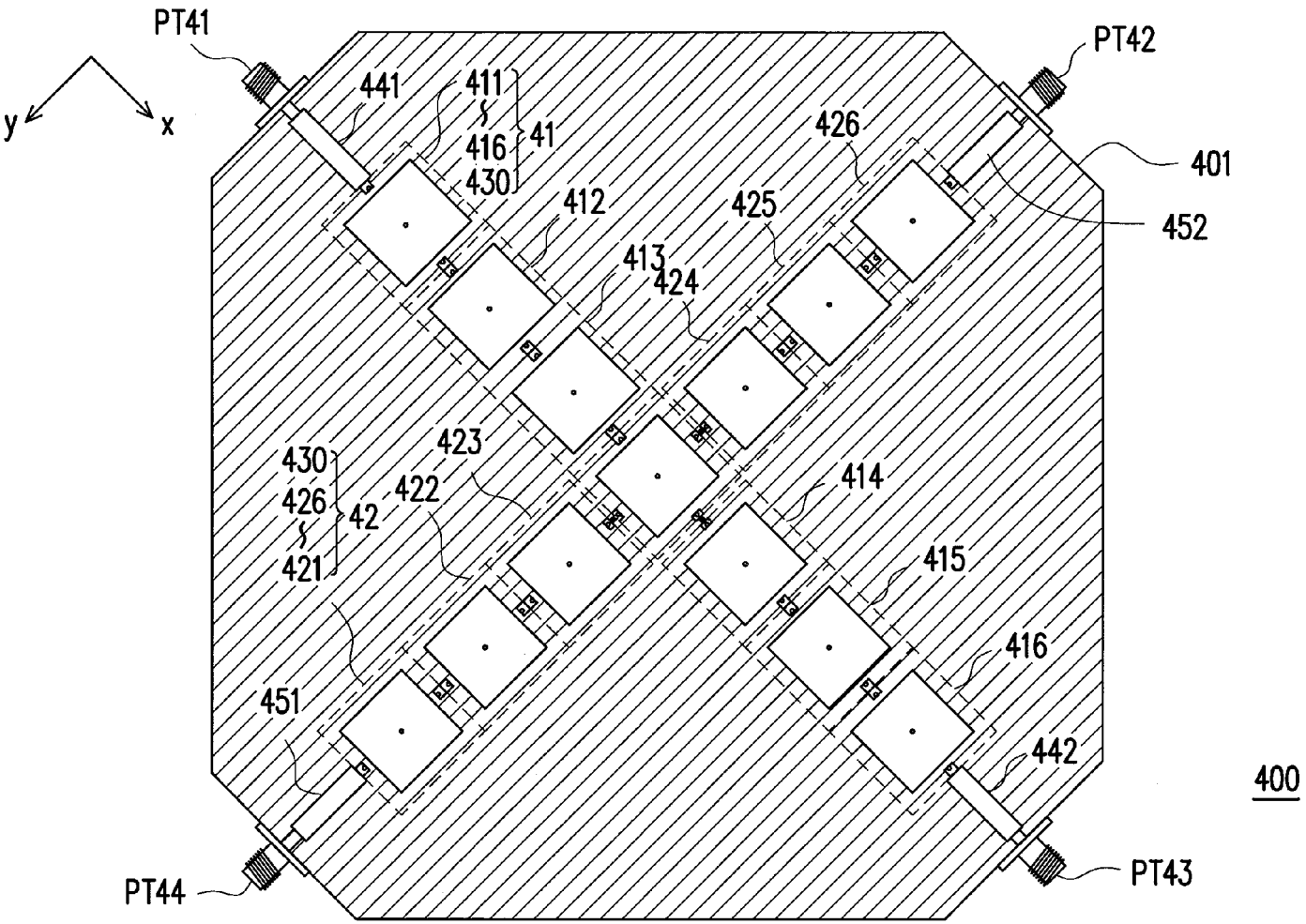
FIG. 4 and FIG. 5 are respectively a top view and a bottom view of a leaky-wave antenna capable of multi-plane scanning according to an embodiment of the present invention.
Figure 5:
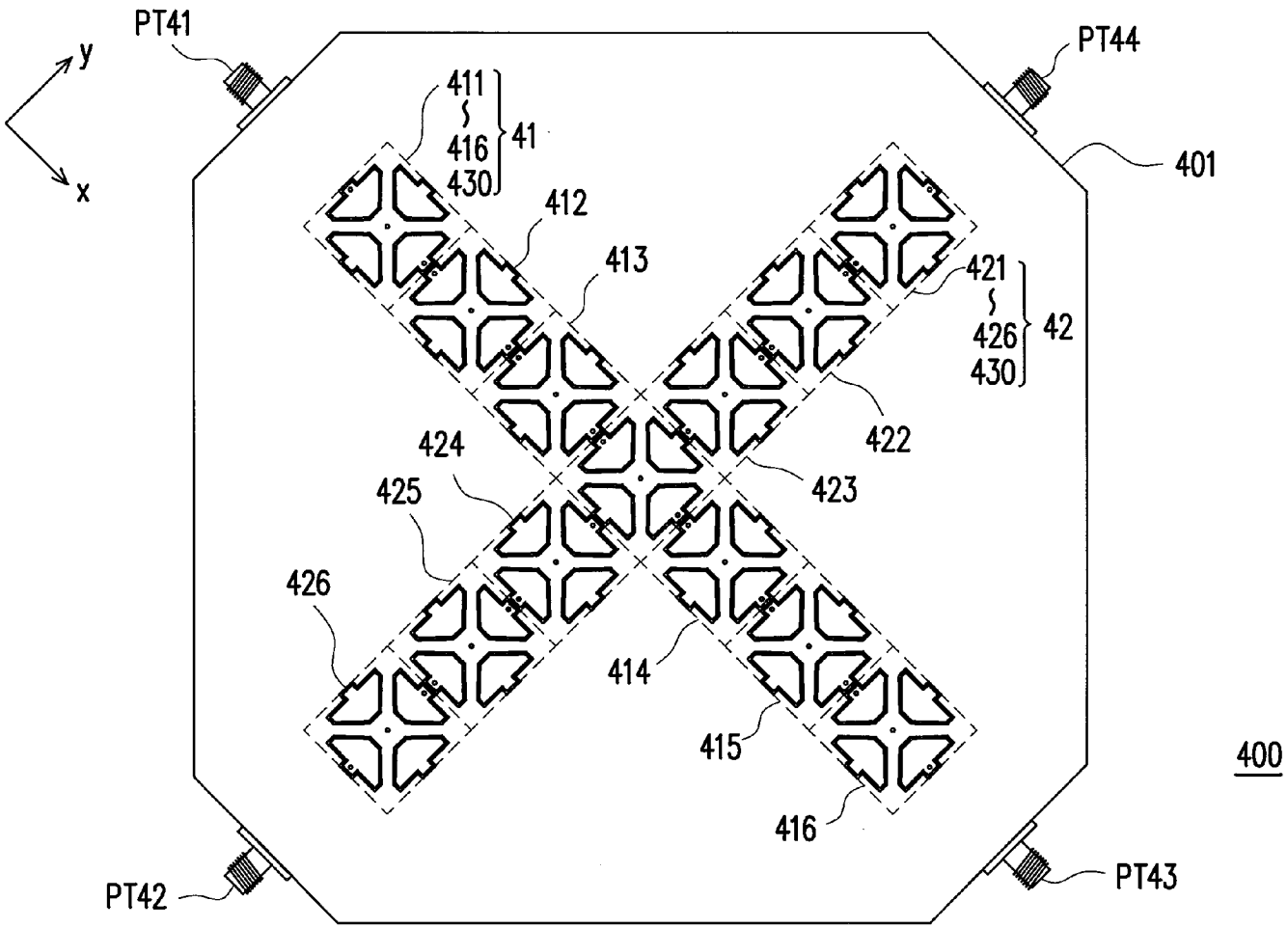
Figure 6:
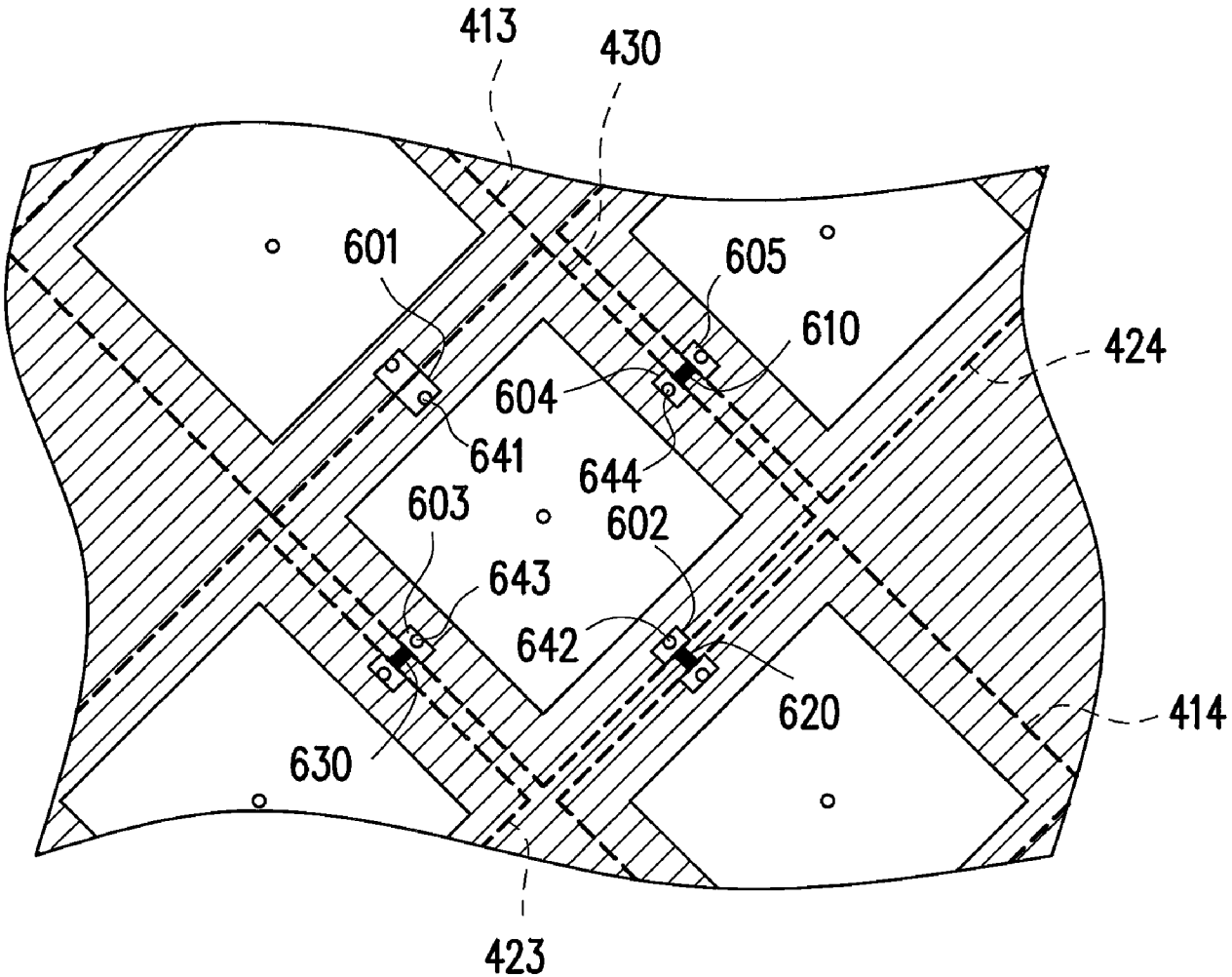
FIG. 6 is a partial enlarged diagram illustrating a leaky-wave antenna capable of multi-plane scanning of FIG. 5.

Further, two sets of the aforementioned antenna series can be disposed in intersection, and control units can be disposed aside the intersection of the antenna series to form the leaky-wave antenna capable of multi-plane scanning. For example, FIG. 4 and FIG. 5 are respectively a top view and a bottom view of the leaky-wave antenna capable of multi-plane scanning according to an embodiment of the present invention. FIG. 6 is a partial enlarged diagram illustrating the leaky-wave antenna capable of multi-plane scanning of FIG. 5. Referring to FIGS. 4-6, the leaky-wave antenna capable of multi-plane scanning 400 includes a substrate 401, a first antenna series 41, a second antenna series 42 and a plurality of control units 610-630.

The first antenna series 41, the second antenna series 42 and the control units 610-630 are all disposed on the substrate 401, and the first antenna series 41 and the second antenna series 42 are formed by a plurality of antenna units 411-416, 421-426 and 430. Wherein, the first antenna series 41 and the second antenna series 42 are disposed in intersection for sharing the antenna unit 430. In an actual structure, configurations of the antenna units 411-416 and 421-426 are the same as that of the antenna unit 100 of FIG. 1. A configuration of the antenna unit 430 is similar to that of the antenna unit 100 of FIG. 1, and only corresponding transmission lines and conductive vias are added to serially connect different antenna series.

As shown in FIG. 6, the antenna unit 430 includes transmission lines 601-604 and conductive vias 641-644 corresponding to the transmission lines 601-604. The antenna units 411-416 are connected in series to extend outwards from the transmission lines 601 and 602 of the antenna unit 430 to form the first antenna series 41, and the antenna units 421-426 are connected in series to extend outwards from the transmission lines 603 and 604 of the antenna unit 430 to form the second antenna series 42. In other words, the first antenna series 41 is formed by the antenna units 411-416 and the antenna unit 430, and the second antenna series 42 is formed by the antenna units 421-426 and the antenna unit 430. Moreover, two ends of the antenna series 41 are electrically connected to matching wires 441 and 442 with a quarter wavelength, so as to match impedances of feed-in ports PT41 and PT43. Comparatively, two ends of the antenna series 42 are electrically connected to matching wires 451 and 452 with a quarter wavelength, so as to match impedances of feed-in ports PT42 and PT44.

Figure 7:
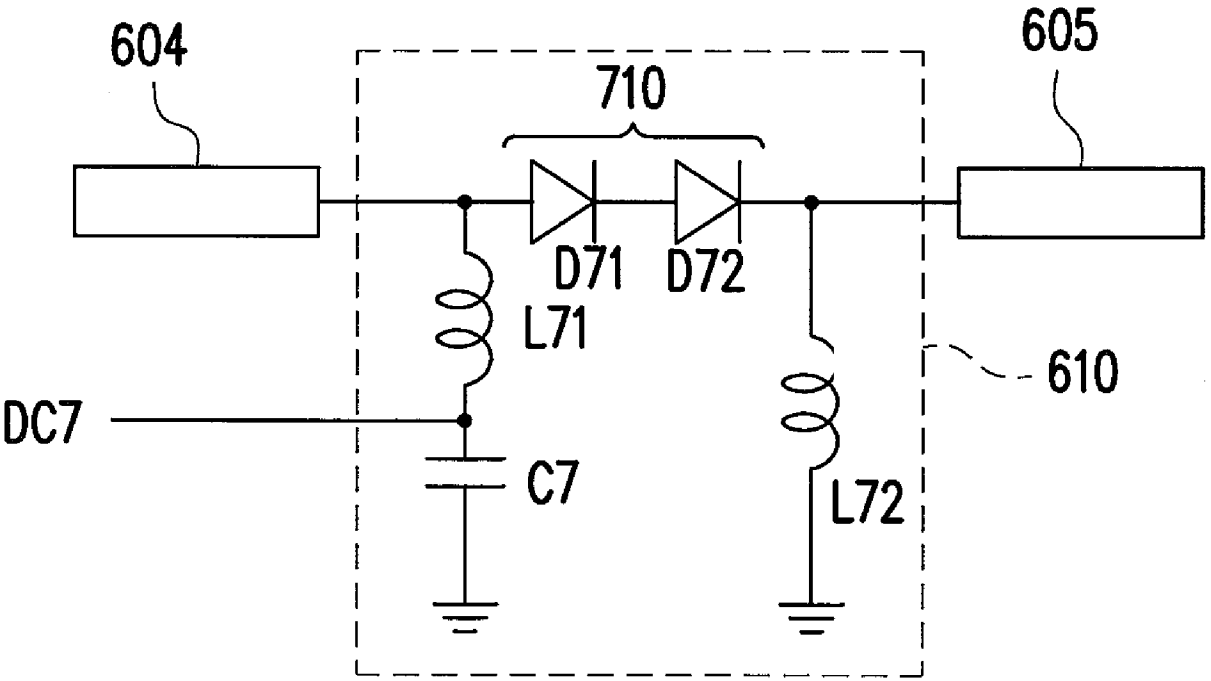
FIG. 7 is a circuit schematic diagram illustrating a control unit according to an embodiment of the present invention.

Further, as shown in FIG. 6, the transmission lines 602-604 of the antenna unit 430 are electrically connected to the antenna units 414, 423 and 424 through the control units 610-630. Therefore, the leaky-wave antenna capable of multi-plane scanning 400 can control conduction states of transmission paths between the transmission lines 602-604 and the antenna units 414, 423 and 424 through the control units 610-630. FIG. 7 is a circuit schematic diagram illustrating a control unit according to an embodiment of the present invention. Referring to FIG. 7, taking the control unit 610 as an example, the control unit 610 includes a diode series 710, an inductor L71, a capacitor C7 and an inductor L72. Here, the diode series 710 is formed by serially connected diodes D71 and D72. An anode of the diode series 710 is electrically connected to the transmission line 604 of the control unit 430, and a cathode of the diode series 710 is electrically connected to a transmission line 605 of the control unit 424. A first end of the inductor L71 is electrically connected to the anode of the diode series 710, and a second end of the inductor L71 is used for receiving a direct current (DC) voltage DC7.

Figures 8A, 8B, 8C:
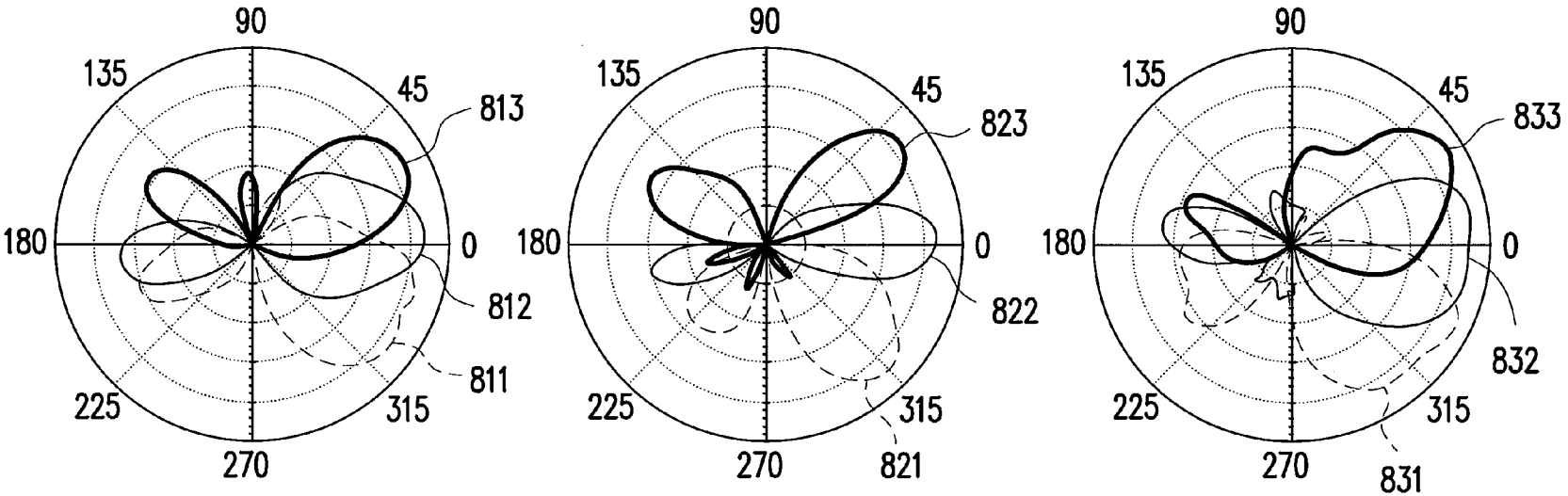
FIG. 8A is a measuring diagram of far-field radiation patterns of a 45-degree scanning plane of an antenna.
FIG. 8B is a measuring diagram of far-field radiation patterns of a 0-degree scanning plane of an antenna.
FIG. 8C is a measuring diagram of far-field radiation patterns of a −45-degree scanning plane of an antenna.

A first end of the capacitor C7 is electrically connected to the second end of the inductor L71, and a second end of the capacitor C7 is electrically connected to the ground. A first end of the inductor L72 is electrically connected to the cathode of the diode series 710, and a second end of the inductor L72 is electrically connected to the ground. During an actual operation, when the DC voltage DC7 is switched to a positive voltage level, the diode series 710 is conducted, so that a transmission path between the transmission line 604 and the transmission line 605 is conducted. Comparatively, when the DC voltage DC7 is switched to a negative voltage level, the diode series 710 is not conducted, so that the transmission path between the transmission line 604 and the transmission line 605 is not conducted. To avoid the DC voltage DC7 influencing the operation of the antenna, the DC voltage DC7 is isolated from the ground through the capacitor C7, and is transmitted to the diode series 710 through the inductor L71. Moreover, the inductor L72 is used for conducting the DC voltage DC7 to the ground.

beam performs continuous scanning along with the frequency variation in any of the scanning planes. For example, FIG. 8A is a measuring diagram of far-field radiation patterns of the 45-degree scanning plane of the antenna. Wherein, curves 811-813 are respectively the radiation patterns when an operation frequency f of the antenna 400 is 2.26 GHz, 2.48 GHz and 2.88 GHz. Moreover, FIG. 8B is a measuring diagram of far-field radiation patterns of the 0-degree scanning plane of the antenna. Wherein, curves 821-823 are respectively the radiation patterns when the operation frequency f of the antenna 400 is 2.26 GHz, 2.48 GHz and 2.88 GHz. Further, FIG. 8C is a measuring diagram of far-field radiation patterns of the −45-degree scanning plane of the antenna. Wherein, curves 831-833 are respectively the radiation patterns when the operation frequency f of the antenna 400 is 2.26 GHz, 2.48 GHz and 2.88 GHz.

TABLE ONE

| | 45-degree scanning plane | | 0-degree scanning plane | | −45-degree scanning plane | |
|---|---|---|---|---|---|---|
| | Beam direction | Antenna gain | Beam direction | Antenna gain | Beam direction | Antenna gain |
| f = 2.26 GHz | −39 degrees | 3.99 dBi | −45 degrees | 5.3 dBi | −29 degrees | 3.97 dBi |
| f = 2.48 GHz | 5 degrees | 4.1 dBi | 1 degree | 4.96 dBi | 5 degrees | 4.02 dBi |
| f = 2.88 GHz | 26 degrees | 4.2 dBi | 38 degrees | 3.89 dBi | 43 degrees | 4.1 dBi |

In this way, by switching the DC voltage level, the control units 610-630 can control the conducting states of the transmission paths between the transmission lines 602-604 and the antenna units 414, 423 and 424, so that the leaky beam radiated by the leaky-wave antenna capable of multi-plane scanning 400 can be switched to one of a plurality of scanning planes. For example, when the control unit 610 conducts the transmission paths between the transmission line 604 and the antenna unit 424, and the control units 620 and 630 maintains the respective transmission paths thereof in a non-conducting state, the energy of the antenna is transmitted from the feed-in port PT41 to the feed-in port PT42. Now, the leaky-wave antenna capable of multi-plane scanning 400 can be regarded as an orthogonal-type leaky-wave antenna. Therefore, the leaky beam is synthesized by two orthogonal sub leaky beams, and an angle Φ of the scanning plane is about 45 degrees.

When the control unit 620 conducts the transmission paths between the transmission line 602 and the antenna unit 414, and the control units 610 and 630 maintains the respective transmission paths thereof in the non-conducting state, the energy of the antenna is transmitted from the feed-in port PT41 to the feed-in port PT43. Now, the leaky-wave antenna capable of multi-plane scanning 400 can be regarded as a one-dimensional leaky-wave antenna, and the angle Φ of the scanning plane is about 0 degree. On the other hand, when the control unit 630 conducts the transmission paths between the transmission line 603 and the antenna unit 423, and the control units 610 and 620 maintains the respective transmission paths thereof in the non-conducting state, the energy of the antenna is transmitted from the feed-in port PT41 to the feed-in port PT44, and the angle Φ of the scanning plane is about −45 degree.

In other words, the leaky-wave antenna capable of multi-plane scanning 400 can control the control units 610-630 to switch the leaky beam to one of the three scanning planes. On the other hand, according to the sweep-frequency characteristic of the control units 411-416, 421-426 and 430, the leaky Referring to FIGS. 8A-8C, the characteristic of the leaky-wave antenna capable of multi-plane scanning 400 is shown in the table one. When the operation frequency f of the antenna 400 is 2.26 GHz, the antenna 400 works at the left-hand leaky area and generates the backward radiation. Moreover, the measured main beam directions of the antenna 400 in the three scanning planes are respectively −39 degrees, −45 degrees and −29 degrees, the measured maximum antenna gains are respectively 3.99 dBi, 5.3 dBi and 3.97 dBi, and the measured half power beam-width are respectively 58 degrees, 37 degrees and 61 degrees. When the operation frequency f of the antenna 400 is 2.48 GHz, the antenna 400 works at the balance frequency point and generates the broadside radiation. Moreover, the measured main beam directions of the antenna 400 in the three scanning planes are respectively 5 degrees, 1 degree and 5 degrees, the measured maximum antenna gains are respectively 4.1 dBi, 4.96 dBi and 4.02 dBi, and the measured half power beam-width are respectively 44 degrees, 30 degrees and 59 degrees.

Further, when the operation frequency f of the antenna 400 is 2.88 GHz, the antenna 400 works at the right-hand leaky area and generates the forward radiation. Moreover, the measured main beam directions of the antenna 400 in the three scanning planes are respectively 26 degrees, 38 degree and 34 degrees, the measured maximum antenna gains are respectively 4.2 dBi, 3.89 dBi and 4.1 dBi, and the measured half power beam-width are respectively 41 degrees, 26 degrees and 43 degrees. According another aspect, the antenna 400 can continuously scan for 65 degrees along with the frequency variation in the 45-degree scanning plane, and can continuously scan for 83 degrees along with the frequency variation in the 0-degree scanning plane, and can continuously scan for 63 degrees along with the frequency variation in the −45-degree scanning plane.

It should be noticed that in FIG. 4 and FIG. 5, the metal sheets in the antenna units 411-416, 421-426 and 430 are squares, and the transmission lines 601-604 are respectively configured at four sides of the metal sheet of the middle antenna unit 430. Therefore, the antenna units 411-416 of the first antenna series 41 are connected in series along a first predetermined direction while taking the middle antenna unit 430 as a center, and the antenna units 421-426 of the second antenna series 42 are connected in series along a second predetermined direction while taking the middle antenna unit 430 as a center, wherein the first predetermined direction and the second predetermined direction are mutually perpendicular, so that the first antenna series 41 and the second antenna series 42 are intersected to form a cross structure, and generate the three scanning planes.

However, in an actual application, shapes of the metal sheets in the antenna units 411-416, 421-426 and 430 can also be circular, hexagonal or octagonal. In case that the shape of the metal sheet is octagonal, the leaky-wave antenna capable of multi-plane scanning 400 further includes two additional sets of antenna series intersected with the antenna series 41 and 42, so as to form a *-shape structure. Moreover, the leaky-wave antenna capable of multi-plane scanning 400 further includes four additional control units for controlling transmission paths formed at the intersection of the two added antenna series. In this way, the leaky-wave antenna capable of multi-plane scanning 400 can generate seven scanning planes. Deduced by analogy, the leaky-wave antenna capable of multi-plane scanning 400 may have a more omni-directional scanning function as the antenna series and the control units are increased.

In summary, in the present invention, the antenna series having the beam scanning function are disposed in intersection, and the control units are disposed at the intersection of the antenna series. In this way, the conduction states of the transmission paths provided by the control units can be controlled by switching the DC voltage level, so that the leaky beam radiated by the leaky-wave antenna capable of multi-plane scanning is switched to one of the scanning planes. Therefore, the leaky-wave antenna capable of multi-plane scanning may simultaneously have the beam scanning function and the beam switching function. Moreover, the leaky-wave antenna capable of multi-plane scanning has a planar structural design, so that it can be miniaturized, and since the antenna series are disposed in intersection, the circuit features of the leaky paths of the antenna are similar, so that usage of complicated matching circuits is unnecessary.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A leaky-wave antenna capable of multi-plane scanning, comprising:

a substrate;

a first antenna series and a second antenna series, disposed on the substrate, and comprising a plurality of antenna units, wherein the first antenna series intersects with the second antenna series to share a predetermined antenna unit among the antenna units, and a part of the antenna units are connected in series to extend outwards from a first and a second transmission lines of the predetermined antenna unit to form the first antenna series, and the other antenna units are connected in series to extend outwards from a third and a fourth transmission lines of the predetermined antenna unit to form the second antenna series; and a plurality of control units, disposed at peripheral of the predetermined antenna unit for controlling transmission paths between the first to the fourth transmission lines and the antenna units, and switching a leaky beam to one of a plurality of scanning planes, wherein the leaky beam scans along with a frequency variation through the antenna units.

2. The leaky-wave antenna capable of multi-plane scanning as claimed in claim 1, wherein the antenna units in the first antenna series are connected in series along a first predetermined direction while taking the predetermined antenna unit as a center, and the antenna units in the second antenna series are connected in series along a second predetermined direction while taking the predetermined antenna unit as a center.

3. The leaky-wave antenna capable of multi-plane scanning as claimed in claim 2, wherein the first predetermined direction and the second predetermined direction are mutually perpendicular, so that the first antenna series and the second antenna series are intersected to form a cross structure.

4. The leaky-wave antenna capable of multi-plane scanning as claimed in claim 1, wherein the antenna units respectively comprises:

a metal ground layer, disposed on a first surface of the substrate, and having a plurality of slots for dividing a plurality of metal blocks that are not electrically connected with each other;

a metal sheet, disposed on a second surface of the substrate, and being partially overlapped to the metal blocks in a vertical projection plane;

a first conductive via, penetrating through the metal ground layer, the substrate and the metal sheet, wherein the metal sheet is electrically connected to the metal ground layer through a first conductive pole in the first conductive via;

a fifth transmission line, disposed on the second surface of the substrate and located at a side of the metal sheet, wherein the fifth transmission line is partially overlapped to a first metal block of the metal blocks on the vertical projection plane;

a second conductive via, penetrating through the fifth transmission line, the substrate and the first metal block, wherein the fifth transmission line is electrically connected to the first metal block through a second conductive pole in the second conductive via;

a sixth transmission line, disposed on the second surface of the substrate and located at another side of the metal sheet, wherein the sixth transmission line is partially overlapped to a second metal block of the metal blocks on the vertical projection plane; and a third conductive via, penetrating through the sixth transmission line, the substrate and the second metal block, wherein the sixth transmission line is electrically connected to the second metal block through a third conductive pole in the third conductive via.

5. The leaky-wave antenna capable of multi-plane scanning as claimed in claim 4, wherein the metal blocks are mutually symmetric relative to a geometric center of the metal sheet.

6. The leaky-wave antenna capable of multi-plane scanning as claimed in claim 4, wherein the first conductive via is overlapped to a geometric center of the metal sheet on the vertical projection plane.

7. The leaky-wave antenna capable of multi-plane scanning as claimed in claim 4, wherein a shape of the metal sheet is rectangular, circular, hexagonal or octagonal.

8. The leaky-wave antenna capable of multi-plane scanning as claimed in claim 4, wherein the antenna units are respectively equivalent to a composite right/left-hand (CRLH) transmission line, and a balance frequency point of the CRLH transmission line relates to sizes of the metal sheet, the first conductive pole, the second conductive pole and the metal blocks.

9. The leaky-wave antenna capable of multi-plane scanning as claimed in claim 8, wherein the metal sheet, the first conductive pole and the metal ground layer are equivalent to a left-hand inductor of the CRLH transmission line.

10. The leaky-wave antenna capable of multi-plane scanning as claimed in claim 8, wherein the fifth transmission line, the first metal block and the second conductive pole are equivalent to a left-hand capacitor of the CRLH transmission line.

11. The leaky-wave antenna capable of multi-plane scanning as claimed in claim 1, wherein the control units respectively comprise:

a diode series, having an anode electrically connected to one of the first to the fourth transmission lines, and a cathode electrically connected to one of the antenna units;

a first inductor, having a first end electrically connected to the anode of the diode series;

a capacitor, having a first end electrically connected to a second end of the first inductor, and a second end electrically connected to ground; and a second inductor, having a first end electrically connected to the cathode of the diode series, and a second end electrically connected to the ground.

12. The leaky-wave antenna capable of multi-plane scanning as claimed in claim 1, wherein the first antenna series and the second antenna series respectively comprise a first matching wire and a second matching wire, and the first matching wire and the second matching wire are electrically connected to two ends of the first antenna series and the second antenna series.

* * * * *